US008297884B1

(12) United States Patent
Khachaturian

(10) Patent No.: US 8,297,884 B1
(45) Date of Patent: Oct. 30, 2012

(54) FLOATING SECURITY BARRIER

(76) Inventor: Jon Khachaturian, New Orleans, LA (US)

( * ) Notice: Subject to any disclaimer, the term of this patent is extended or adjusted under 35 U.S.C. 154(b) by 293 days.

(21) Appl. No.: 12/603,672

(22) Filed: Oct. 22, 2009

Related U.S. Application Data

(60) Provisional application No. 61/107,942, filed on Oct. 23, 2008.

(51) Int. Cl.
*B63B 35/44* (2006.01)

(52) U.S. Cl. ..... 405/195.1; 114/266

(58) Field of Classification Search ..... 114/264, 114/266
See application file for complete search history.

(56) References Cited

U.S. PATENT DOCUMENTS 4,136,994 A * 1/1979 Fuller ..... 405/27
4,652,173 A * 3/1987 Kallestad ..... 405/69
6,425,710 B1 7/2002 Khachaturian
6,435,773 B1 8/2002 Khachaturian
6,435,774 B1 8/2002 Khachaturian
* cited by examiner

*Primary Examiner* — Tara Mayo-Pinnock
(74) *Attorney, Agent, or Firm* — Garvey, Smith, Nehrbass & North, L.L.C.; Charles C. Garvey, Jr.; Vanessa M. D'Souza

(57) ABSTRACT

A floating security barrier and method of use includes a plurality of buoys that are placed on a water surface and about a marine structure or platform to be protected. A plurality of trusses are provided, each truss spanning between a pair of buoys. A connection joins each truss at its end portion to a buoy. In one embodiment, the connection is above the center of gravity of the truss. A curtain depends downwardly from each truss, spanning between the truss and the water surface area. The curtain can extend below the surface of the water. The method includes encircling a structure to be protected with a plurality of buoys, each buoy connected with a truss that spans between a pair of buoys. Each truss preferably connects to a buoy at a position that is above the center of gravity of the truss. The method includes hanging a curtain downwardly from its truss, the curtain spanning between the truss and the water surface area. The method includes using the curtain and buoys to disallow any vessel from traveling from a position outside the perimeter to a position within the perimeter.

20 Claims, 3 Drawing Sheets

FLOATING SECURITY BARRIER

CROSS-REFERENCE TO RELATED APPLICATIONS

Priority of U.S. Provisional Patent Application Ser. No. 61/107,942, filed Oct. 23, 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to marine structures, including marine barriers that prevent vessels from entering a restricted area. Even more particularly, the present invention relates to an improved floating security barrier utilizing a plurality of buoys that can be positioned to form a perimeter around the marine platform or other structure to be protected. Trusses span between the buoys, including a truss that spans between a pair of buoys, a curtain extending downwardly from each truss spanning between the truss and a position below the water surface.

2. General Background of the Invention

Marine structures can be very valuable objects that not only cost a substantial amount of money, but also generate substantial revenue on a day to day basis. An example is an offshore oil and gas well producing platform. Such platforms are often located many miles from the closest port and are thus susceptible to attack by pirates, terrorists, or other criminal element.

BRIEF SUMMARY OF THE INVENTION

The present invention provides a solution to the problem of security around a floating offshore structure such as a platform, oil platform, drilling platform or the like. The present invention provides a floating security barrier in the form of a plurality of buoys that float on a water surface and that are positioned in spaced apart orientation to form a perimeter around the platform or structure to be protected.

A plurality of trusses are provided, each truss spanning between a pair of buoys.

The connection joins each truss at its end portions to the buoys, the connection of a truss to a buoy preferably being above the center of gravity of the truss.

A curtain extends downwardly from the truss and is supported by the truss. The curtain spans between the truss and the water surface area. In one embodiment, the buoys have a height and a diameter, the height being much greater than the diameter.

In one embodiment, the curtain includes multiple sections of chain.

In one embodiment, the curtain is attached to both a truss and to a buoy.

In one embodiment, at least one of the buoys is anchored to a seabed.

In one embodiment, an articulating connection forms all or part of the connection that joins a truss to a buoy.

In one embodiment, a pinned connection forms all or part of the connection between a truss and a buoy.

In one embodiment, more than one articulating connection joins each buoy to a truss or trusses.

The present invention provides a method of providing floating security that protects a marine structure from unauthorized contact such as with an intruding vessel. The method includes surrounding the marine structure with a plurality of buoys, each buoy floating on a water surface and positioned in spaced apart orientation to form a perimeter around the marine structure to be protected.

The method includes spanning a truss between each pair of buoys.

The method includes connecting each truss at its end portions to a buoy with a connection that is positioned above the center of gravity of the truss.

The method includes hanging a curtain downwardly from the truss, the curtain spanning between the truss and the water surface.

The method includes providing a curtain that disallows any vessel from traveling from a position outside the perimeter to a position next to the marine structure.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
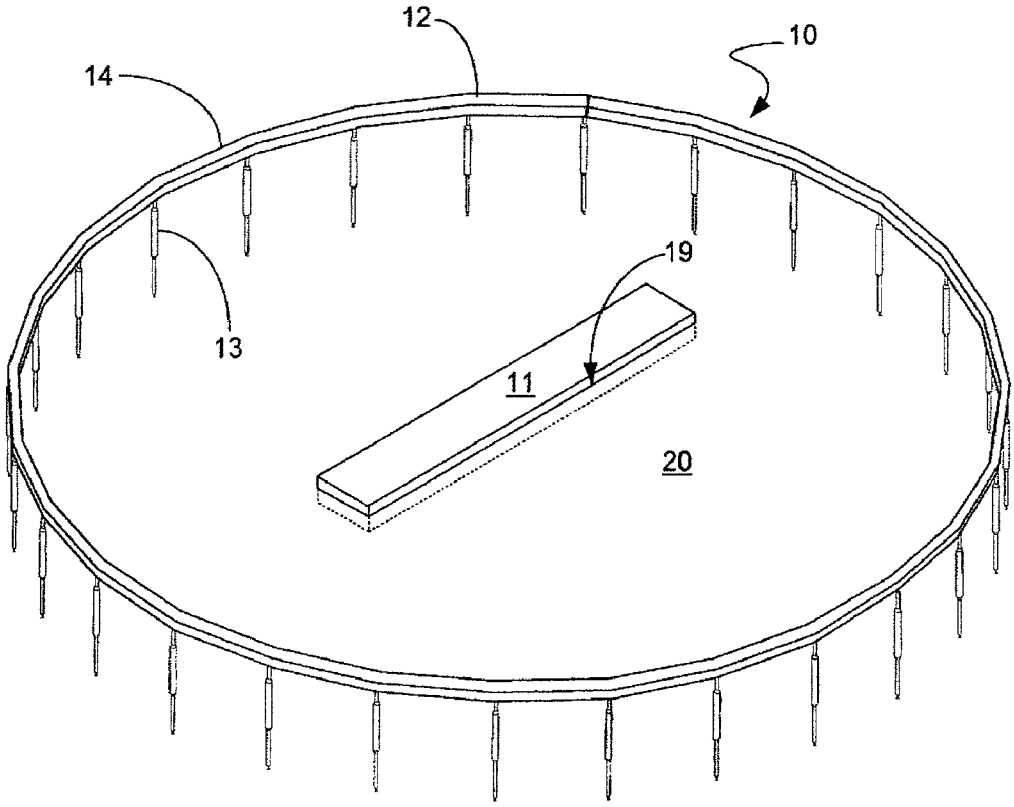
FIG. 1 is a perspective view of the preferred embodiment of the apparatus of the present invention.

FIGS. 1-4 show the preferred embodiment of the apparatus of the present invention, designated generally by the numeral 10. Floating security barrier 10 is used to protect a marine structure 11 from unauthorized contact. Such unauthorized contact or entry can be from an intruder vessel such as a power boat. Such intruder vessels can be operated by criminals, pirates, terrorists or the like. Such an intruder vessel can be armed and/or carry explosives. In the past, intruder vessels of this type have been used to inflict damage upon marine structures 11.

The term "marine structure" as used herein should be construed in its broadest sense to include any marine structure worthy of protection including but not limited to oil and gas well drilling platforms, oil and gas well production platforms, crew quarters, drill ships, anchored vessels, production platforms, refineries, factories, or the like.

The perimeter 12 is in the form of a plurality of buoys 13 that are in spaced apart positions. Each buoy 13 has an upper end portion 17 and a lower end portion 16. In one embodiment, each buoy 13 has a height and a diameter, the height being much greater than the diameter as shown in FIG. 3. For example, in FIG. 2, each buoy has a link of about 300 feet and a diameter of less than 20 feet.

A truss 14 is provided having a truss upper elevation 24. Truss 14 is attached at its end portions 25, 26 to a buoy 13. Each buoy 13 attaches to truss 14 with connection 15. An anchor line 18 can anchor one or more buoys 13 to the seabed.

Figure 2:
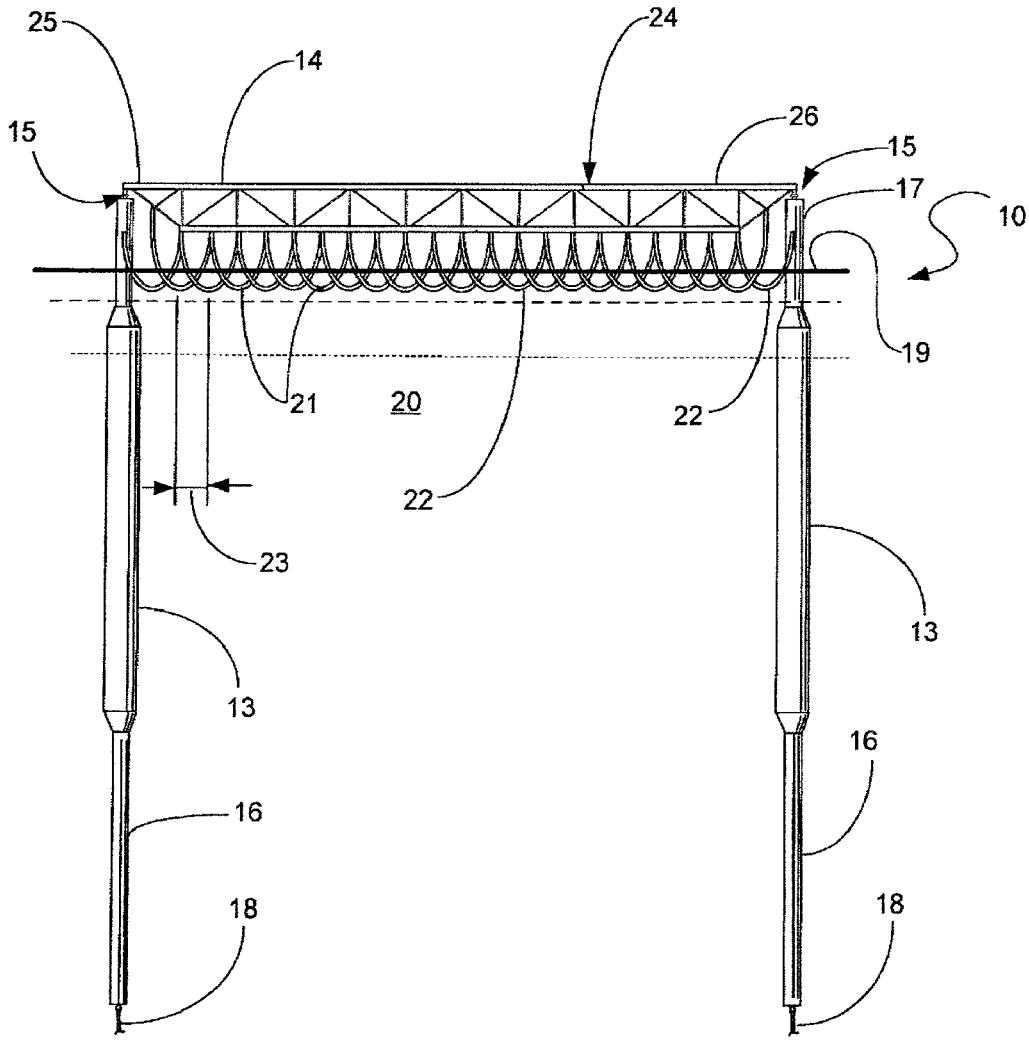
FIG. 2 is another perspective view of the preferred embodiment of the apparatus of the present invention.
Figure 3:
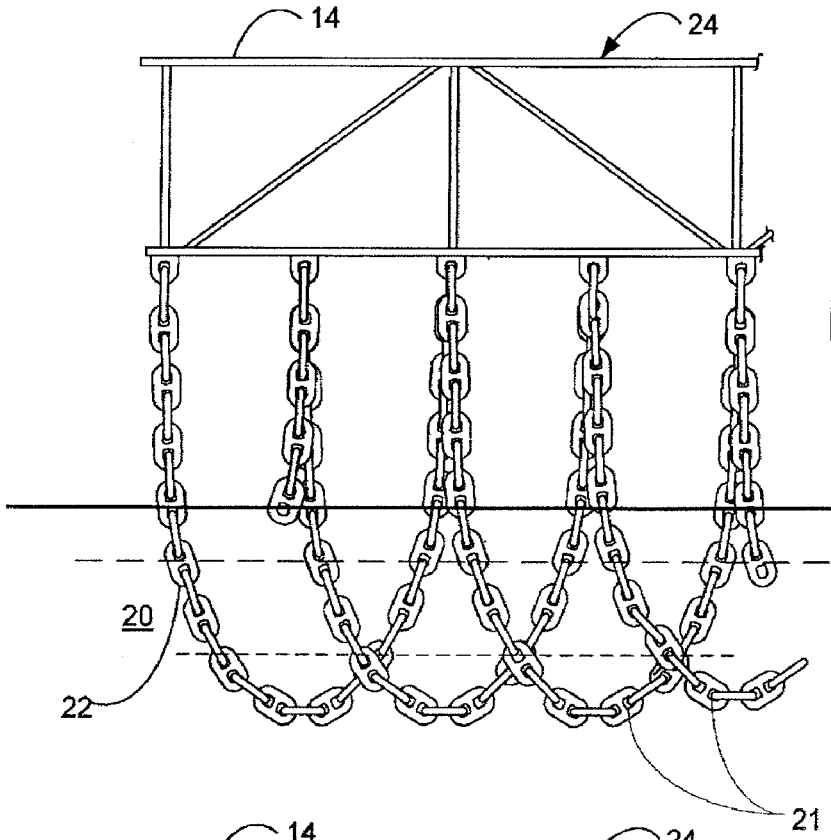
FIGS. 3 and 4 are fragmentary elevation views of the preferred embodiment of the apparatus of the present invention.

A connection 15 is used to join an end portion 25 or 26 of truss 14 to a buoy 13 as shown in FIG. 2. It should be understood that connection 15 can be any suitable connection such as for example an articulating connection, multiple articulating connections, a pinned connection, or a combination of an articulating and a pinned connection or multiple connections that are a combination of articulating connections and pinned connections. Such an articulating connection can be seen for example in U.S. Pat. Nos. 6,425,710; 6,435,773; and 6,435,774: (each of these mentioned patents is hereby incorporated herein by reference). Each connection 15 is preferably above the center of gravity of truss 14.

Figure 4:
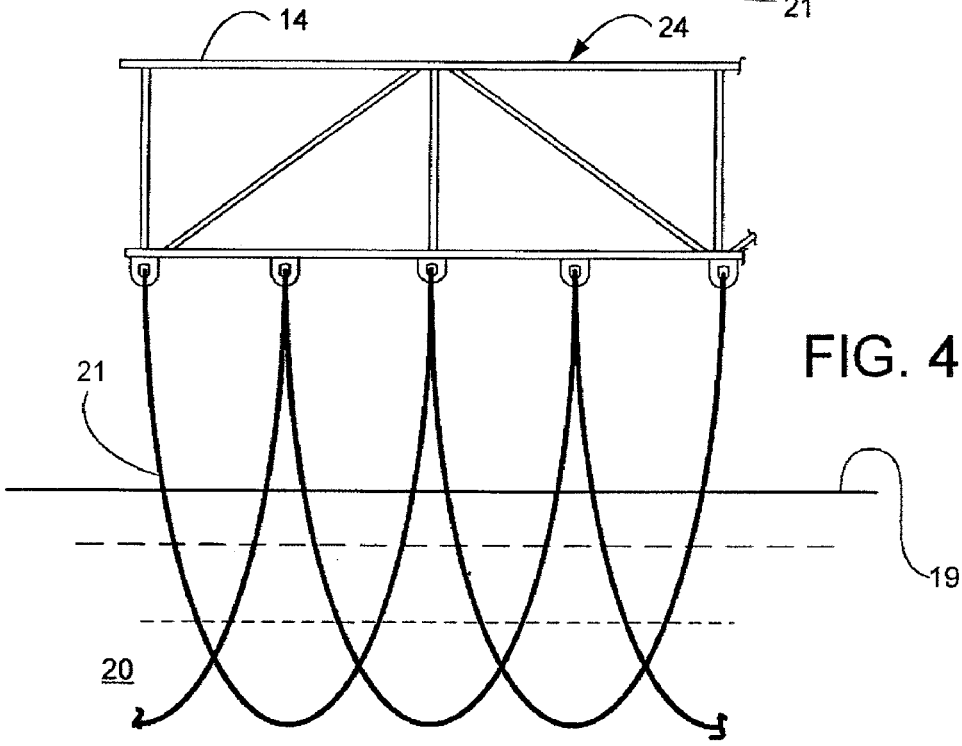

A curtain 21 extends between truss 14 and the water surface area 19 as shown in FIGS. 2-4. In one embodiment, curtain 21 extends to ocean 20, below water surface 19 as shown in FIGS. 2 and 4. Curtain 21 can be in the form of a plurality of links of chain 22, each link of chain 22 being in the form of a "u" as shown in FIG. 3. A spacing 23 between each link of chain 22 can be sufficiently small to prevent even small motorized vessels from passing curtain 21. For example, the spacing 23 could be six inches apart. Each link of chain 22 could be very heavy chain, difficult for one or two or three individuals to move it more than a very small distance. The curtain 21 could be covered with any type of fabric or mesh or wire material.

Each buoy 13 can be anchored to prevent floating security barrier 10 from substantially moving even in rough weather. For example, one or more of the buoys 13 could be anchored to an underlying seabed using anchor lines 18 that extend from the lower end portion 16 of a buoy 13 to the seabed.

The following is a list of parts and materials suitable for use in the present invention.

PARTS LIST

| Part Number | Description |
|---|---|
| 10 | floating security barrier |
| 11 | marine structure |
| 12 | perimeter |
| 13 | buoy |
| 14 | truss |
| 15 | connection |
| 16 | lower end portion |
| 17 | upper end portion |
| 18 | anchor line |
| 19 | water surface |
| 20 | ocean |
| 21 | curtain |
| 22 | link of chain |
| 23 | spacing |
| 24 | upper elevation of truss |
| 25 | truss end portion |
| 26 | truss end portion |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A floating security barrier, comprising:

a) a plurality of buoys floating on a water surface and positioned in spaced apart orientation to form a partially above water surface perimeter around a marine platform to be protected, each buoy having an upper portion spaced above the water surface, a middle portion at the water's surface, and a lower portion below the water surface;

b) a plurality of trusses, each spaced above the water surface, each truss spanning between the upper portions of a pair of buoys, each truss occupying a generally vertical plane and having a truss upper end portion and a truss lower end portion that is below said truss upper end portion, both said truss upper and truss lower end portions positioned above the water's surface;

c) a connection that joins each truss at its end portion to a buoy, the connection being above the center of gravity of the truss;

d) a curtain that extends downwardly from each truss, spanning between the truss and the water surface area; and e) wherein a portion of said curtain remains above said water surface to define an above water surface barrier between said truss lower end portion and the water's surface.

2. The floating security barrier of claim 1 wherein the buoys have a height and a diameter, the height being greater than the diameter.

3. The floating security barrier of claim 1 wherein the curtain includes multiple sections of chain.

4. The floating security barrier of claim 1 wherein the curtain is attached to both a truss and a buoy.

5. The floating security barrier of claim 1 wherein at least one of the buoys is anchored to a seabed.

6. The floating security barrier of claim 1 wherein an articulating connection joins each truss to a buoy.

7. The floating security barrier of claim 1 wherein a pinned connection forms at least part of the connection between each truss and a buoy.

8. The floating security barrier of claim 1 wherein more than one articulation connections join a buoy to trusses.

9. The floating security barrier of claim 1 wherein the perimeter is circular in shape.

10. The floating security barrier of claim 1 wherein each truss has an upper portion that is about on even elevation with the top of two buoys.

11. The floating security barrier of claim 1 further comprising connecting each truss to a buoy with one or more articulating connections.

12. The floating security barrier of claim 11 wherein more than one articulation connections joins a buoy to a truss.

13. A method of floating security that protects a marine structure from unauthorized contact, comprising the steps of:

a) surrounding the marine structure with a plurality of buoys floating on a water surface and positioned in spaced apart orientation to form a perimeter around a marine structure to be protected, each buoy having a portion that extends above the water surface and a portion that extends below the water surface;

b) spanning a truss between each pair of buoys and each truss supported by the buoys in an elevated position above the water surface, each truss having an upper end portion and a lower end portion;

c) connecting each truss to a pair of the buoys with first and second spaced apart connections that are each positioned above the center of gravity of the truss;

d) hanging a curtain downwardly from each truss, the curtain spanning between the truss lower end portion and the water surface, both of said truss upper and lower end portions being above the water surface;

e) disallowing vessel travel from a position outside the perimeter to the marine structure with a portion of said curtain that remains above said water surface to define an above water surface barrier between said truss lower end portion and the water surface.

14. The method of claim 13 wherein the buoys have a height and a diameter, the height being greater than the diameter.

15. The method of claim 13 wherein the curtain includes multiple sections of chain.

16. The method of claim 13 further comprising attaching the curtain to both a truss and a buoy.

17. The method of claim 13 further comprising anchoring at least one of the buoys to a seabed.

18. The method of claim 13 further comprising connecting each truss to a buoy with one or more pinned connections.

19. The method of claim 13 wherein the perimeter is generally circular in shape.

20. The method of claim 13 further comprising placing each truss upper portion on even elevation with the top of two buoys.

* * * * *